US007882829B2

(12) United States Patent
Witzigreuter

(10) Patent No.: US 7,882,829 B2
(45) Date of Patent: Feb. 8, 2011

(54) SMALL PROJECTILE LAUNCHING AIR GUN

(76) Inventor: John D. Witzigreuter, 3221 S. Cherokee La., Woodstock, GA (US) 30188

( * ) Notice: Subject to any disclaimer, the term of this patent is extended or adjusted under 35 U.S.C. 154(b) by 94 days.

(21) Appl. No.: 12/480,479

(22) Filed: Jun. 8, 2009

(65) Prior Publication Data

US 2010/0307472 A1 Dec. 9, 2010

(51) Int. Cl.
*F41B 11/00* (2006.01)

(52) U.S. Cl. ..... 124/65; 124/69; 124/70

(58) Field of Classification Search ..... 124/65, 124/69, 70

See application file for complete search history.

(56) References Cited

U.S. PATENT DOCUMENTS

| | | | | |
|---|---|---|---|---|
| 1,818,810 | A * | 8/1931 | Miller | 124/69 |
| 2,293,957 | A * | 8/1942 | Wells | 124/69 |
| 2,301,653 | A * | 11/1942 | Wells | 124/73 |
| 2,566,181 | A * | 8/1951 | Fitch | 124/69 |
| 3,394,694 | A | 7/1968 | Leclerc | |
| 4,212,285 | A | 7/1980 | Cagan | |
| 4,843,751 | A | 7/1989 | Ferri | |
| 5,363,834 | A | 11/1994 | Stuchlik | |
| 5,429,108 | A | 7/1995 | Hsieh | |
| 5,592,931 | A * | 1/1997 | Johnson et al. | 124/69 |
| 5,690,091 | A * | 11/1997 | Bissonnette | 124/80 |
| 5,924,413 | A | 7/1999 | Johnson | |
| 7,156,085 | B2 | 1/2007 | Lewis | |
| 7,287,526 | B1 | 10/2007 | Bligh | |
| 7,316,565 | B2 | 1/2008 | Liao | |
| 7,404,398 | B2 | 7/2008 | Henricks | |
| 2005/0000505 | A1 * | 1/2005 | Pedicini et al. | 124/63 |
| 2006/0225717 | A1 | 10/2006 | Ma | |
| 2007/0051353 | A1 | 3/2007 | Nygarrd | |
| 2007/0204841 | A1 | 9/2007 | Liao | |

* cited by examiner

*Primary Examiner*—Troy Chambers
(74) *Attorney, Agent, or Firm*—QuickPatents, Inc.; Kevin Prince

(57) ABSTRACT

The present device is a launcher for a projectile, comprising an enclosure that is adapted to be held by a human hand. The enclosure comprises a barrel aperture, a pump aperture, and a trigger aperture. The launcher further comprises a pump assembly that comprises a pump piston traversing the pump aperture. The pump piston is configured to be actuated by a user and can be reciprocated in and out of a pump cylinder. The launcher comprises a compression chamber in fluid communication with the piston cylinder through a check valve that only allows air to pass from within the piston cylinder into the compression chamber. The launcher comprises a trigger that opens the compression chamber and sends compressed air into a barrel that can have a projectile stored therein. The trigger is configured to be manually operated by a user. The barrel is in fluid communication with the compression chamber through a trigger valve. The compact design allows for direct fluid communication between the pump assembly, the compression chamber, and the barrel.

10 Claims, 3 Drawing Sheets

SMALL PROJECTILE LAUNCHING AIR GUN

CROSS-REFERENCE TO RELATED APPLICATIONS

Not Applicable.

STATEMENT REGARDING FEDERALLY SPONSORED RESEARCH AND DEVELOPMENT

Not Applicable.

1. Field of the Invention

This invention relates to projectile launchers, and more particularly to a handheld pneumatic projectile launcher.

2. Discussion of Related Art

Children enjoy imitating things from the adult world and toy weapons are no exception. From a hand carved wooden replica to factory produced models, toy weapons come in all sizes, prices, and materials from wood to metal. One of the most common toy weapons is the toy gun, or toy launcher for launching projectiles. Projectiles can be launched using stored energy, for example, compressed gas or a coiled spring. There are variety of mechanisms described in the prior art for launching these projectiles. Such mechanisms include high pressure storage tanks, use of a powerful spring to push a piston which compresses air to push a projectile, use of a hand pump to pressurize the air for subsequent release, and use of a direct acting means such as a solenoid plunger or a centrifugal force to push the projectile out of a barrel.

An exemplary toy gun is described in U.S. Pat. No. 4,212,285 to Cagan et al., on Jul. 15, 1980. As described, the dart gun can be cocked by a user gripping tabs with his or her thumb and forefinger and pulling rearwardly to retract a piston carrier located within an air cylinder, into a cocked position. In doing so, the user compressing a spring located on one end of the piston. A shoulder engages the rearward end of the piston carrier to releasably latch the piston carrier in its rearward, cocked position. A trigger can be pulled rearwardly, thus releasing the piston carrier from its cocked position so that the spring displaces the piston carrier forwardly at high speed to deliver compressed air to a rearward end of the gun barrel through an air passage. Forward movement of the piston is terminated before the piston strikes the dart loaded in the barrel, by engagement of the piston with circumferentially spaced stop pins molded integrally into with the forward end of the air cylinder. One of the drawbacks with this toy gun is that the piston moving forward does not displace enough compressed air to deliver a powerful strike to the dart loaded in the barrel. As a result, the dart does not travel very far, and must be lightweight.

U.S. Pat. No. 5,363,834 to Stuchlik, on Nov. 15, 1984, describes an air pellet gun that is switchable between a manually pumped compression mode and a gas cartridge compression mode. The body of the pellet gun comprises a compressed gas storage chamber between a check valve and a firing valve disposed in a cylinder. Air is allowed to pass through the check valve and into the compressed storage chamber. Air is forced into the storage chamber by the reciprocating action of a piston member. Successive reciprocation of piston member builds up the pressure in the storage chamber by forcing air through check valve. Thereafter, compressed air is released by the momentary opening of firing valve that causes a hammer to strike an actuating rod member. The compressed air passes through a passage and into the barrel of the gun to propel a BB or pellet. Some of the drawbacks associated with the air gun is that it does not generate enough power to efficiently shoot projectiles larger than a BB or a pellet. Also, the larger size of the barrel can place friction force on a pellet as it exits the barrel, thereby slowing the pellet down. Larger sized ammunition would not travel far using such a gun in a manual compression mode.

U.S. Pat. No. 5,924,413 to Johnson et al., on Jul. 20, 1999, describes an air compressed gun. An operator actuates a pump to pressurize a supply of air by grasping a handle and reciprocating a cylinder rod back and forth within a cylinder. Pressurized air is passed through a pressure tube into a pressure tank. Manual actuation of a trigger allows pressurized air within the pressure tank to pass through a pressure tube into an actuator manifold. The pressurized air then passes out of a lower opening and through a second pressure tube and into a release valve manifold. The pressurized air within the release valve manifold causes a plunger to move to a forward position sealing an opening. Pressurized air then flows between the plunger and the release valve manifold so as to pressurize a pressure chamber. Eventually, pressurized air within the pressure chamber flows into a launch tube holding a projectile, and propels the projectile out of a magazine barrel and through a gun barrel. The drawbacks of such an air compression gun include the amount of working parts necessary to get the pressurized air from the pressure tank to the launch tube. As a result, compressed air seeps out of the gun and is lost between the pressure tank and the launch tube. The compression delivery is not very efficient.

U.S. Pat. No. 7,156,085 B2, to Lewis et al., on Jan. 2, 2007, describes a toy gun that comprises a barrel having a bay for receiving a soft projectile, a stock connected pivotally to the barrel and encasing a pneumatic cylinder, and piston that is primed upon pivotally opening the stock and barrel. The pneumatic cylinder and the piston communicate with the bay when the stock and barrel are closed. The toy gun also comprises a trigger for releasing the piston to force air into the bay for dispatching a projectile therefrom. Upon depression of the trigger, the piston moves rapidly forward to force a blast of air through the pneumatic cylinder, to rapidly pressurize air within the hollow that holds a projectile. This will cause the projectile to be dispatched from the barrel. The drawback associated with this gun is that a user cannot control the amount of pressurized air that strikes the projectile. It is the same amount of pressurized air each time.

The present teachings disclose a novel launcher for launching a projectile. Like the patents listed above, the launcher generates compressed air to launch a projectile from the launcher. The launcher addresses the lack of power and loss of compressed air in the gun's cited above, because the launcher comprises a compact design where a compression chamber is in direct fluid communication with a barrel that can hold a projectile. The pump assembly and the compression chamber are also in direct fluid communication with each other, such that compressed air is added directly to the compression chamber. Such a launcher prevents loss of compressed air because the pump, the compression chamber, and the firing chamber are all in direct fluid communication. The launcher also provides a user the ability to choose how much compressed air they would like to use when firing the launcher.

SUMMARY OF THE INVENTION

The present device is a launcher for a projectile, comprising an enclosure that is adapted to be held by a human hand. The enclosure comprises a barrel aperture, a pump aperture, and a trigger aperture. A piston cylinder is fixed within the enclosure, and the launcher further comprises a pump assembly that comprises a pump piston traversing the pump aperture. The pump piston is configured to be actuated by a user and can be reciprocated in and out of the pump cylinder. The pump piston comprises a piston sealing means that is adapted to slide within the piston cylinder. The piston sealing means is adapted to let air from outside of the enclosure enter through the pump aperture, past the piston sealing means and only into but not out of the piston cylinder.

The launcher comprises a compression chamber in fluid communication with the piston cylinder through a check valve that only allows air to pass from within the piston cylinder into the compression chamber. As a user actuates the pump piston, the pressurized air forces the check valve open, and compressed air can be stored in the compression chamber. The launcher comprises a trigger including a manual actuator traversing the trigger aperture and fixed with a rearward end of a trigger piston. The trigger piston comprises a forward seal means to prevent air from escaping out of the barrel aperture and a rear seal means to prevent air from escaping out of the trigger aperture. The trigger piston is slidably engaged with a rear trigger piston cylinder, such that the trigger piston can slidably move along the rear trigger piston cylinder.

The launcher also comprises a barrel in fluid communication with the compression chamber through a trigger valve. The trigger valve traverses the barrel aperture and includes a valve aperture that allows fluid communication between the barrel and the compression chamber. When the trigger piston is in a retracted position the trigger valve is open, such that compressed air can travel from the compression chamber into the barrel. When the trigger piston is in a forward position, the trigger valve is closed, and fluid communication between the compression chamber and the barrel is prevented.

In operation, a user can load the barrel with a projectile or the user can leave the barrel empty and place the projectile in the barrel at a later time. A user can actuate the pump piston forward and backward several times within the piston cylinder to compress air within the compression chamber. A user can actuate the manual actuator of the trigger by pulling the manual actuator rearwardly to slide the trigger piston rearward until the compressed air can exit the compression chamber and enter the barrel. The compressed air can exit the compression chamber to blow the projectile out of the distal end of the barrel.

The present invention is an air launcher that does require many working components that can often cause compressed air to dissipate within a toy gun. The pump assembly is fluidly connected to the compression chamber, and the compression chamber is fluidly connected to the barrel. The compact design allows for efficient air transfer. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

The present invention relates to a projectile launching air gun. The launcher can be hand-held by a user. A user can manually load the launcher with one or more projectiles, for example, a paint ball, a rubber ball, a foam ball, a dart, or other type of projectile. The components of the launcher can be made by of any conventional materials, for example, plastic, rubber, wood, or other desired materials known in the art. The launcher comprises a barrel that the projectile is projected from. The launcher is configured to project the projectile out of the launcher through stored energy in the form of compressed air. The compressed air can be formed through the use of a pump assembly and the compressed air can be stored in a compression chamber. A user can manually pump the assembly any number of desired times to add compressed air into the compression chamber. Once the desired amount of compression has been achieved, the user can pull the trigger, and a loaded projectile can be forced out of the barrel end of the launcher.

Figure 1:
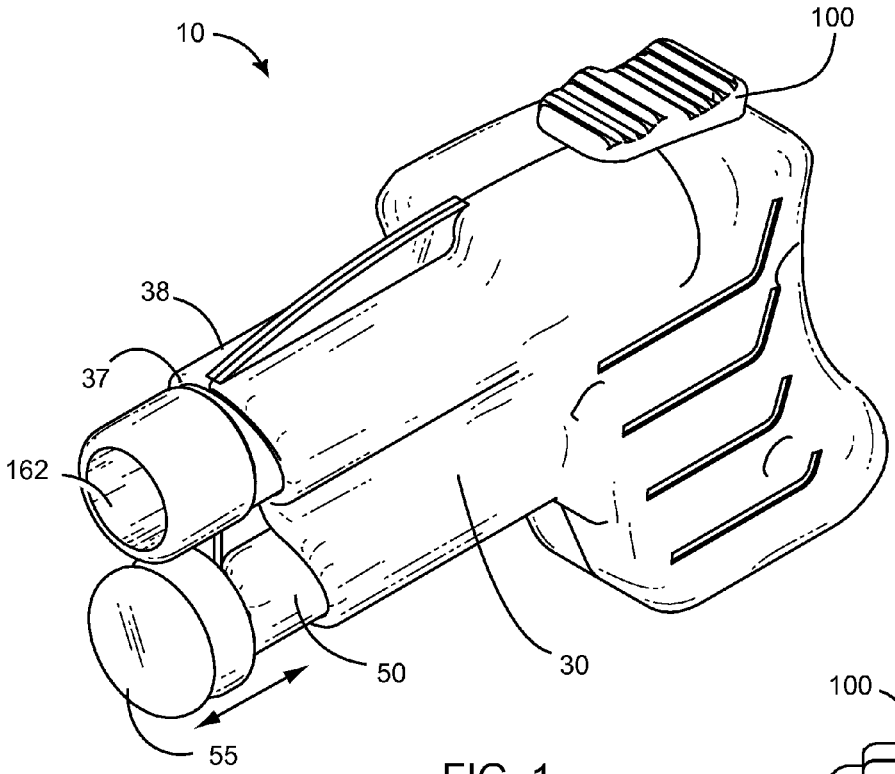
FIG. 1 is an external perspective view of a launcher of the present teachings.
Figure 2:
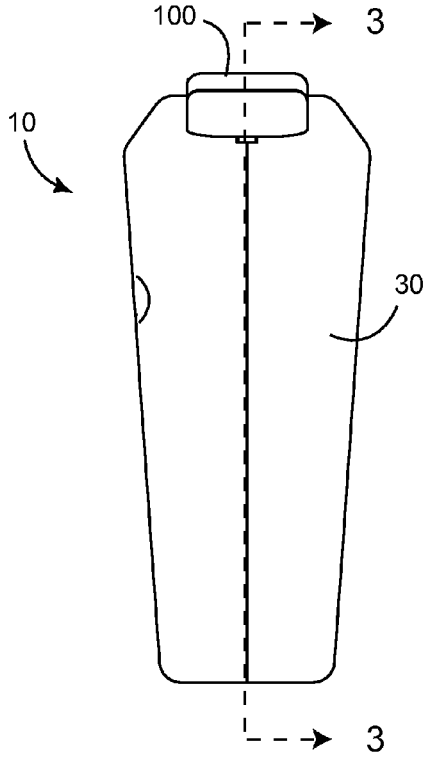
FIG. 2 is a rear view of the launcher of FIG. 1, with a cut-away line down the middle of the launcher.
Figure 3:
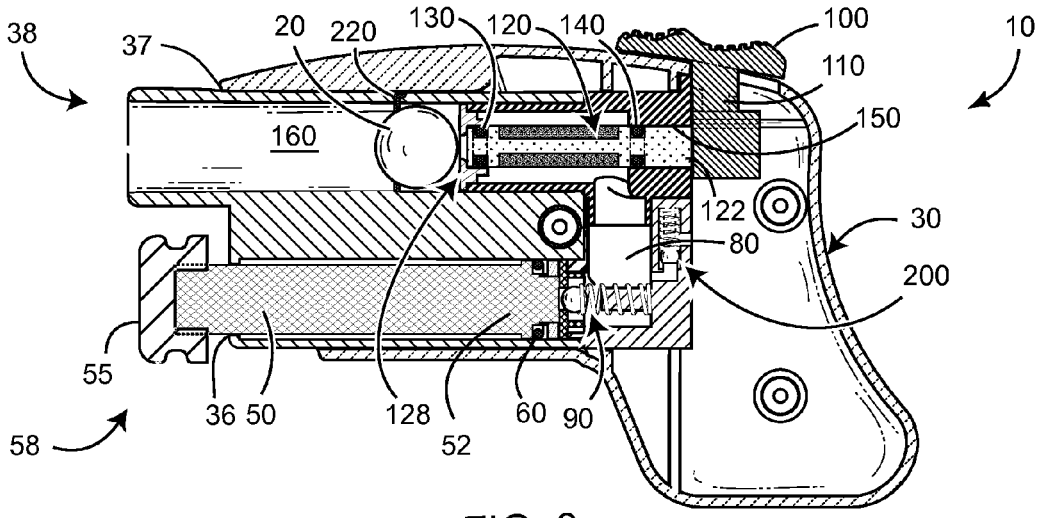
FIG. 3 is a cross-sectional interior view of the launcher illustrated in a ready-to-fire condition taken along lines 3-3 of FIG. 2.

FIG. 1 depicts an external side-perspective view of launcher 10. Launcher 10 comprises an enclosure 30 configured to be held by a human hand, and a trigger 100. FIG. 2 illustrates a rear view of launcher 10, including a cut-away line 3-3. FIGS. 3, 4, 6, and 7 each illustrate an exemplary interior of launcher 10, shown cut-away along line 3-3 of FIG. 2. As shown in FIG. 3, enclosure 30 comprises a barrel aperture 37, disposed at a forward end 38 thereof, a pump aperture 36, and a trigger aperture 39. In some embodiments, the trigger aperture 39 is disposed at approximately a rearward end 32 of enclosure 10. A user can load one or more projectiles into barrel aperture 37. Barrel aperture 37 can be of any desired shape or size. In the exemplary embodiment the barrel aperture has a circular diameter. As will be appreciated, the diameter of the barrel aperture can be of any desired shape, for example, square, elliptical, rectangular, triangular, or other desired shape. Barrel aperture can be of any length desired, for example, 2 inches, 4 inches, 6 inches, 8 inches, or other desired length.

Figure 4:
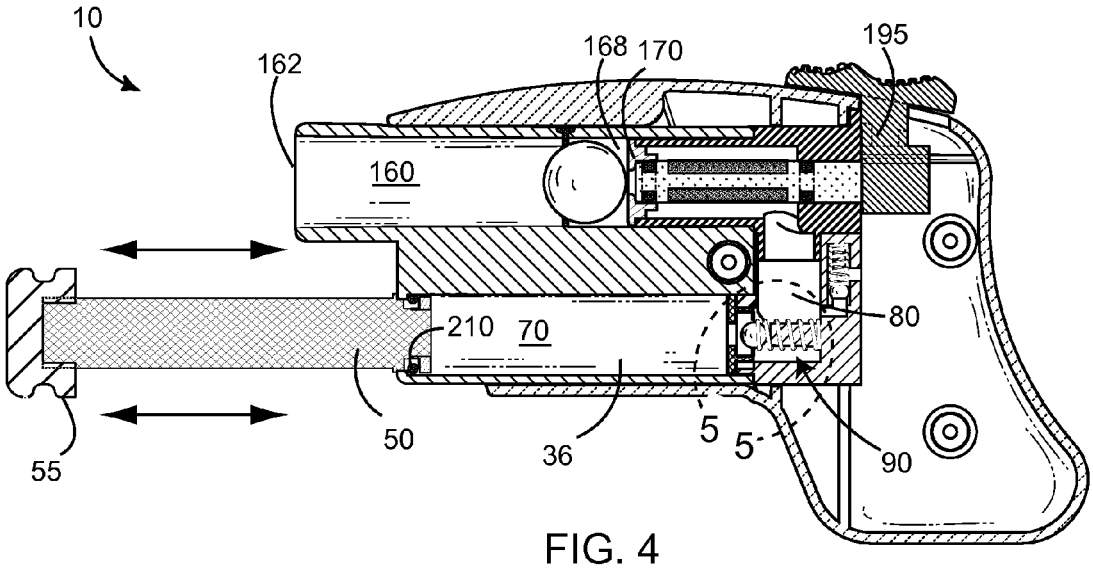
FIG. 4 is a cross-sectional view of the launcher illustrated in a preparation condition in which a piston is manually pumped to compress air into an air chamber.
Figure 6:
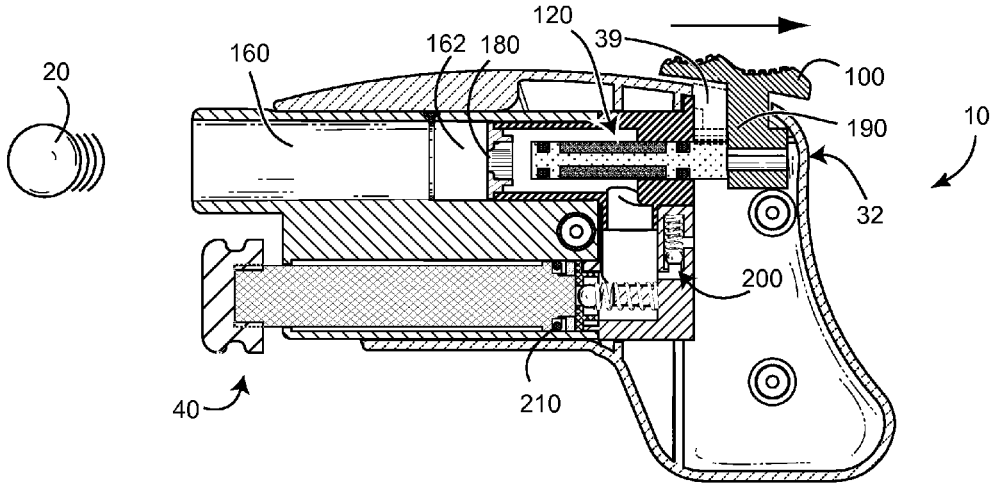
FIG. 6 is a cross-sectional view of the launcher illustrated in a just-fired condition and further illustrating a trigger drawn rearward to connect the air chamber with a firing chamber.

A pump assembly 40, as shown in FIG. 6, can traverse, or move through, pump aperture 36. As shown in FIGS. 3-4, pump aperture 36 can be disposed below barrel aperture 37. In some embodiments, pump aperture 36 can be disposed above the barrel aperture or adjacent the barrel aperture. Pump assembly 40 comprises a pump piston 50 traversing pump aperture 36 and having a distal end 58 thereof, and a grasping element 55 also located at distal end 58 thereof. Pump piston 50 further comprises a proximal end 52 including a piston sealing means 60 that is adapted to slide within a piston cylinder 70. Piston cylinder 70 is fixed at least partially within enclosure 30.

Piston sealing means 60 is adapted to let air from outside of enclosure 30 enter through pump aperture 36, past piston sealing means 60, and into but not out of piston cylinder 70. The piston cylinder can be of any desired size. For example, the piston cylinder can comprise a diameter of 0.5 inches, 1 inch, 2 inches, 3 inches, or other desired diameter. In some embodiments, the piston cylinder is not circular in diameter but, for example, square, rectangular, elliptical, or other desired shape. Pump piston 50 can be of a size such that it snugly slides into pump aperture 36. A user can manually reciprocate pump piston 50 in and out of piston cylinder 70 in a direction as shown by the arrows in FIG. 4. Grasping element 55 can be any desired size and shape. Grasping element 55 is configured to be grasped by a user. Grasping element 55 can have a diameter that is larger than the diameter of piston cylinder 70, thereby preventing grasping element 55 from entering piston cylinder 70 during a pumping operation. In some embodiments, the pump aperture is disposed in forward end 38 of enclosure 30. In yet other embodiments, the pump aperture can be disposed at a rearward end 32 of enclosure 30.

In some embodiments, piston sealing means 60 can comprise an elastomeric O-ring 210. The elastomeric O-ring can be pulled in the direction of the distal end of the pump piston and the O-ring can be configured to deform away from the piston cylinder, thus allowing air to enter into the piston cylinder. The elastomeric O-ring can be configured such that when the O-ring is pushed toward the compression chamber, the O-ring is not allowed to deform and is held by the pump piston firmly against the piston cylinder, thereby preventing air from passing between the O-ring and the piston cylinder.

Launcher 10 comprises a compression chamber 80 in direct fluid communication with piston cylinder 70 through a check valve 90 that only allows air to pass from within piston cylinder 70 and into compression chamber 80. As a user manually actuates pump piston 50 back and forth, air is pushed against check valve 90. Check valve 90 can comprise a spring configuration, such that when air is pushed against check valve 90, the spring recoils allowing air to pass into the compression chamber. Check valve 90 can be of any well known design in the art. In some embodiments, compression chamber 80 can comprise a second check valve 200 for releasing air within the compression chamber if the air pressure within the compression chamber exceeds a predetermined threshold. In some embodiments second check valve 200 releases air into the surrounding ambient air and/or into enclosure 30.

Figure 5A:
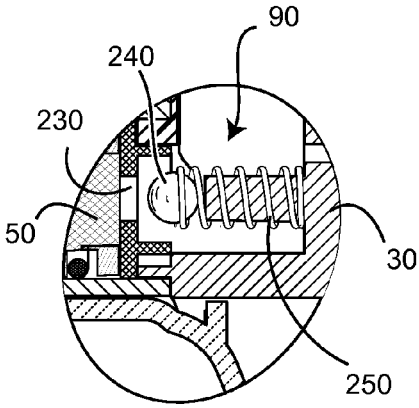
FIG. 5A is an enlarged cross-sectional view of the launcher of FIG. 1 taken generally along lines 5-5 in FIG. 4 further illustrating a check valve in an open position.
Figure 5B:
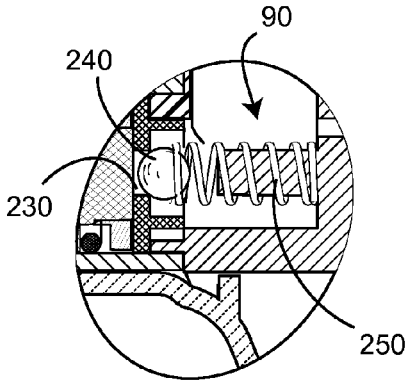
FIG. 5B is an enlarged cross-sectional view of the launcher of FIG. 1 taken generally along lines 5-5 in FIG. 4 further illustrating a check valve in a closed position.

The check valves 90,200 can be of any well-known check valve in the art. FIGS. 5A-5B illustrate the check valve 90 in operation. FIG. 5A illustrates check valve 90 in an open configuration allowing air to enter and/or leave the compression chamber. FIG. 5B illustrates check valve 90 in a close configuration thereby preventing air from entering or leaving the compression chamber. Check valve 90 comprises a check valve ball bearing 240 that is urged by a spring 250 against a check valve aperture 230. The strength of spring 250 determines a pressure threshold for opening check valve 90. As air is pushed against check valve ball bearing 240, the pressure from the air can exceed the pressure threshold of spring 250. This can cause spring 250 to recoil and check valve 90 can open thus allowing air to enter the compression chamber through check valve aperture 230. Once the pressure from the air falls below the pressure threshold of the spring, the spring urges the check valve ball bearing forward against the check valve aperture, thereby closing the check valve 200.

Launcher 10 comprises a trigger 100, as shown in FIG. 3, which comprise a manual actuator 110 traversing trigger aperture 39 and affixed with a rearward end 122 of a trigger piston 120. In some embodiments, trigger aperture 39 and manual actuator 110 of trigger 100 are each positioned at a rearward end 32 of the enclosure 32. In some embodiments, the manual actuator can be adapted to be actuated by a user's thumb when holding the enclosure 30 in his hand. Trigger piston 120 comprises a forward seal means 130 disposed at a forward end 128 thereof, and a rear seal means 140, slidably engaged with a rear trigger piston cylinder 150 that is proximate a rearward end of trigger piston 120. Trigger piston 120 and manual actuator 110 can move back and forth slidably on rear trigger piston cylinder 150. Rear seal means 140 can prevent compressed air stored in the compression chamber from leaving through the trigger aperture. In some embodiments, as trigger 100 is pulled rearwardly by a user, trigger 100 causes manual actuator 110 to pull trigger piston 120 away from barrel 160, and opens rear forward seal means 130. Compressed air stored in compression chamber 80 is able to exit the compression chamber through the opening, travel into the barrel, and apply force to projectile 20 such that projectile 20 is pushed out of barrel 160. In some embodiments, trigger piston 120 can be at least partially housed in the compression chamber. In some embodiments, forward seal means 130 and/or rear seal means 140 can be an elastomeric O-rings.

Launcher 10 comprises a barrel 160 that is in direct fluid communication with compression chamber 80. As shown in FIG. 4, compression chamber 80 comprises a trigger valve 170 located at a proximal end 168 of compression chamber 80. Trigger valve 170 comprises a valve aperture 180 that allows for fluid communication between barrel 160 and compression chamber 80, such that when trigger valve 170 is opened air can flow from compression chamber 80 into barrel 160. Trigger valve 170 can traverse barrel aperture 37, and can thus move through valve aperture 180 and partially move into distal end 162 of barrel aperture 37. In some embodiments, trigger valve 170 does not traverse barrel aperture 37, but instead rests flush against distal end 162 of barrel aperture 37. Trigger piston 120 can move slidably along rear trigger piston cylinder 150. For example, when trigger 100 is pulled rearwardly and trigger valve 170 is opened, as compressed air begins to exit the compression chamber through valve aperture 180, the compressed air can apply force to trigger piston 120 and can slidably move trigger piston 120 away from valve aperture 180 with pressurized force, and along rear trigger piston cylinder 150. Rear seal means 140 can prevent air from leaving trigger aperture 39, thus forcing air to exit the compression chamber only through valve aperture 180. In some embodiments, barrel 160 includes an elastomeric retainer 220 that can project into the barrel to hold the projectile in place against the valve aperture until the trigger 100 is actuated.

FIGS. 3 and 4 illustrate an example of launcher 10 where trigger piston 120 is in a forward position 195. When the trigger piston 120 is in forward position 195, forward seal means 130 is engaged with valve aperture 180, thus preventing fluid communication between compression chamber 80 and barrel 160. In such an embodiment, compressed air can be added to compression chamber 80. As illustrated in FIG. 4, pump piston 50 can be actuated or reciprocated back and forth, for example, along the directional arrows as shown, such that surrounding ambient air is added to compression chamber 80. In some embodiments, projectile 20 can be added to barrel 160 before the pumping operation occurs, or projectile 20 can be added after the pumping operation occurs. A user can manually pump piston 50 any number of desired times in and out of piston cylinder 70 to achieve a desired amount of compressed air stored in the compression chamber. For example, a user can pump the pump piston, 4 times, 6 times, 10 times, or any other desired amount of times. As air is pressed into piston cylinder 70, piston sealing means 60 can allow for air to enter piston cylinder 70, while at the same time piston sealing means 60 can prevent air from leaving piston cylinder 70.

FIG. 6 illustrates launcher 10 where trigger piston 120 is in a retracted position 190. As trigger 100 is pulled rearwardly by a user, compressed air can force trigger piston 120 to move away from valve aperture 180, and direct fluid communication can occur between compression chamber 80 and barrel 160. Compressed air can force trigger piston 120 to slide along rear trigger piston cylinder 150, thereby allowing air to evacuate the compression chamber in an efficient manner. The compressed air can enter the barrel 160 and strike a rear side of projectile 20 thereby forcing projectile 20 out of barrel 160. As such the trigger valve 170 is pressure balanced for providing smooth operation thereof.

Figure 8:
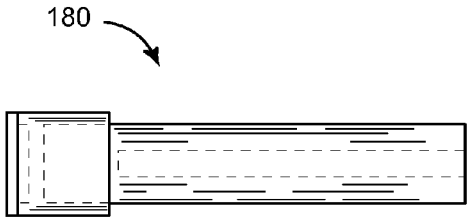
FIG. 8 is a top plan view of the dart of FIG. 7.
Figure 7:
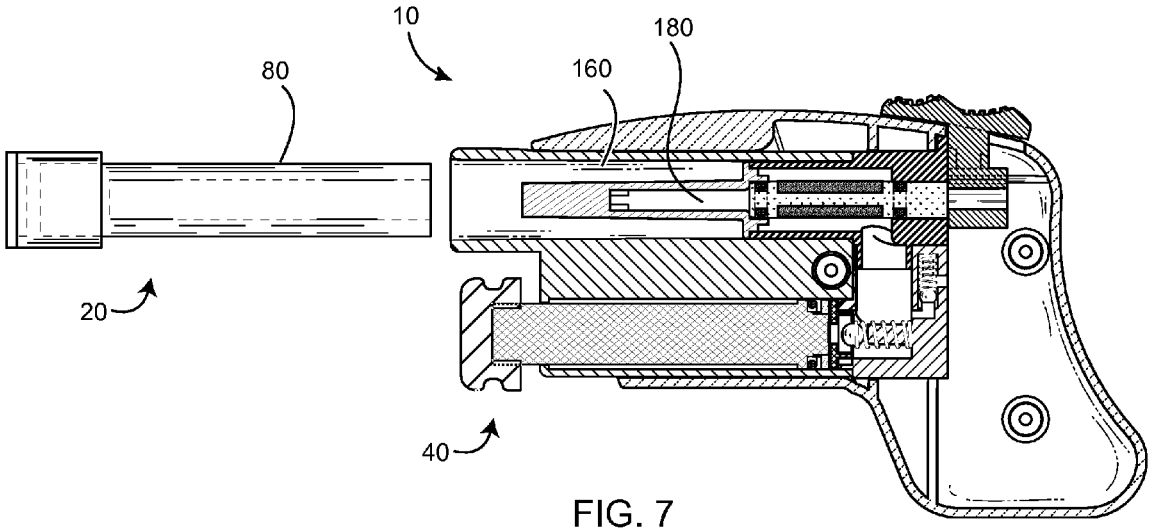
FIG. 7 is a cross-sectional view of the launcher illustrated with a dart launch tube and a projectile comprising a dart.

In some embodiments, projectile 120 can be sized such that projectile 20 fits snugly within barrel 160. In such an embodiment, compressed air can be prevented from escaping around projectile 20, such that almost all the pressure from the compression chamber can be applied to projectile 20. In some embodiments, trigger 100 is fixedly attached to trigger piston 120, such that when trigger 100 is pulled rearwardly, trigger piston 120 moves slidably along rear trigger piston cylinder 150. FIG. 7 illustrates yet another embodiment of the invention where launcher 10 can be used to launch one or more projectiles 20, for example, a dart 180 (FIG. 8), a paintball 20 (FIGS. 3, 4 and 6), a rubber or foam ball (not shown), or the like. In some embodiments, the dart 180 is shaped such that at least one end thereof fits snugly into the barrel 160. When air is released from the compression chamber 80, the snug fit can prevent nearly all the compressed air from leaking around the edge of the dart 180, thus increasing the efficiency of the launcher.

In operation mode, the projectile 20 can be fixed within the barrel 160, or it can be loaded after pumping. A user can actuate the pump piston 50 forward and backward several times within the piston cylinder 70 to compress air within the compression chamber 80. A user can pull the trigger 100 thereby causing the manual actuator 110 of the trigger 100 to be pulled rearward to slide the trigger piston 120 rearward until the compressed air can exit the compression chamber 80 and enter the barrel 160. The compressed air can push the trigger piston 120 rearward against the rear seal means 140 to snap open the trigger valve 170. Compressed air can then exit the valve aperture 180 to blow the projectile 20 out of the distal end 162 of the barrel 160.

While a particular form of the invention has been illustrated and described, it will be apparent that various modifications can be made without departing from the spirit and scope of the invention. For example, the launcher can be used with any suitable projectile, for example, darts, pellets, foam balls, rubber balls, biodegradable objects, or other desired objects. It will also be appreciated that the pump can be disposed anywhere on the launcher, for example, the pump can be disposed such that the pump and the barrel are perpendicular to one another. Accordingly, it is not intended that the invention be limited, except as by the appended claims.

The teachings provided herein can be applied to other systems, not necessarily the system described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

These and other changes can be made to the invention in light of the above Detailed Description. While the above description details certain embodiments of the invention and describes the best mode contemplated, no matter how detailed the above appears in text, the invention can be practiced in many ways. Details of the system may vary considerably in its implementation details, while still being encompassed by the invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A launcher for a projectile comprising:

an enclosure adapted to be held by a human hand, the enclosure including a barrel aperture a forward end thereof, a pump aperture, and a trigger aperture;

a pump assembly comprising a pump piston traversing the pump aperture of the enclosure and having at a distal end thereof a grasping element, a proximal end of the pump piston including a piston sealing means and adapted to slide within a piston cylinder, the piston cylinder fixed within the enclosure, the piston sealing means adapted to let air from outside of the enclosure enter through the pump aperture, past the piston sealing means and only into but not out of the piston cylinder;

a compression chamber in fluid communication with the piston cylinder through a check valve that only allows air to pass from within the piston cylinder into the compression chamber;

a trigger including a manual actuator traversing the trigger aperture and fixed with a rearward end of a trigger piston, the trigger piston including a forward seal means at a forward end thereof and a rear seal means slidably engaged with a rear trigger piston cylinder proximate the rearward end thereof;

a barrel in fluid communication with the compression chamber through a trigger valve at a proximal end thereof and traversing the barrel aperture at a distal end thereof, the trigger valve including a valve aperture that allows fluid communication between the barrel and the compression chamber when the trigger piston is in a retracted position, and prevents such fluid communication when the trigger piston is in a forward position and the forward seal is engaged with the valve aperture;

whereby with the projectile fixed within the barrel and the pump piston actuated forward and backward several times within the piston cylinder to compress air within the compression chamber, the manual actuator of the trigger may be pulled rearward to slide the trigger piston rearward until the compressed air can exit the compression chamber and enter the barrel, the compressed air pushing the trigger piston rearward against the rear seal means to snap open the trigger valve, the compressed air then exiting the valve aperture to blow the projectile out of the distal end of the barrel.

2. The launcher of claim 1 wherein the compression chamber further includes a second check valve for releasing air within the compression chamber if the air pressure within the compression chamber exceeds a predetermined threshold.

3. The launcher of claim 2 wherein the second check valve releases air into the enclosure.

4. The launcher of claim 1 wherein the pump aperture is in the forward end of the enclosure.

5. The launcher of claim 1 wherein the piston sealing means is an elastomeric O-ring that when pulled in the direction of the distal end of the pump piston is allowed to deform away from the piston cylinder, and when pushed toward the compression chamber is not allowed to deform and is held by the pump piston firmly against the piston cylinder, thereby preventing air from passing between the O-ring and the piston cylinder.

6. The launcher of claim 1 wherein the forward seal means and the rear seal means are each elastomeric O-rings.

7. The launcher of claim 1 wherein the barrel includes an elastomeric retainer projecting into the barrel to hold the projectile in place against the valve aperture until the trigger is actuated.

8. The launcher of claim 1 wherein the trigger aperture and the manual actuator of the trigger are each positioned at a rearward end of the enclosure, the manual actuator adapted to be actuated by the user's thumb when holding the enclosure in his hand.

9. The launcher of claim 1 wherein each check valve is comprised of a check valve aperture against which a check valve ball bearing is urged by a spring, the strength of the spring determining a pressure threshold for opening the valve.

10. The launcher of claim 1 wherein the projectile is taken from the set comprising: a paintball, foam dart, rubber ball, and foam ball.

* * * * *